United States Patent [19]

Ostertag et al.

[11] 3,945,446

[45] Mar. 23, 1976

[54] STABILIZER FOR DRILL STRINGS

[75] Inventors: Alfred Ostertag, Celle; Claus Marx, Hannover, both of Germany

[73] Assignee: Christensen Diamond Products Co., Salt Lake City, Utah

[22] Filed: Jan. 2, 1974

[21] Appl. No.: 430,077

[30] Foreign Application Priority Data

Mar. 8, 1973 Germany ..... 2311359

[52] U.S. Cl. ..... 175/323; 175/325; 285/16; 285/381; 308/4 A

[51] Int. Cl.[2] ..... E21B 17/04

[58] Field of Search ..... 308/4 A; 175/325, 323; 285/381, 349, 16; 403/183; 29/426, 446

[56] References Cited

UNITED STATES PATENTS

| | | | |
|---|---|---|---|
| 1,583,262 | 5/1926 | Smith | 308/4 A |
| 1,721,004 | 7/1929 | Debose | 175/325 |
| 1,764,769 | 6/1930 | Woods | 308/4 A |
| 1,810,948 | 6/1931 | Dorn et al. | 308/4 A |
| 2,589,534 | 3/1952 | Buttolph | 175/325 X |
| 2,592,854 | 4/1952 | Boice | 308/4 A |
| 2,617,672 | 11/1952 | Nichols | 403/183 |
| 2,657,956 | 11/1953 | Hall | 308/4 A |
| 2,671,949 | 3/1954 | Welton | 285/334 X |
| 2,869,827 | 1/1959 | Cook | 175/325 X |
| 3,063,143 | 11/1962 | Bodine | 29/426 X |
| 3,114,566 | 12/1963 | Coberly et al. | 285/381 X |
| 3,149,861 | 9/1964 | Larsson | 285/349 |
| 3,322,217 | 5/1967 | Cook | 175/323 |
| 3,482,889 | 12/1969 | Cochran | 308/4 A |
| 3,494,640 | 2/1970 | Coberly et al. | 285/381 X |
| 3,747,700 | 7/1973 | Rilling | 175/325 X |
| 3,820,611 | 6/1974 | King | 175/325 X |

*Primary Examiner*—David H. Brown
*Attorney, Agent, or Firm*—Bernard Kriegel

[57] ABSTRACT

Stabilizer apparatus for a drill string or other running string, including a body structure forming part of a rotary drill string and a stabilizer positioned on an end portion of said body structure, the stabilizer comprising a stabilizer sleeve having a conical interior surface which is shrink-fitted onto a mating external conical surface of such body structure by fluid pressure actuated or hydraulic means, permitting a safe, strong interconnection between the stabilizer and the drill string body structure, which stabilizer can be readily removed when necessary and replaced with another stabilizer similarly shrink-fitted onto the drill string body structure.

11 Claims, 7 Drawing Figures

Fig. 5
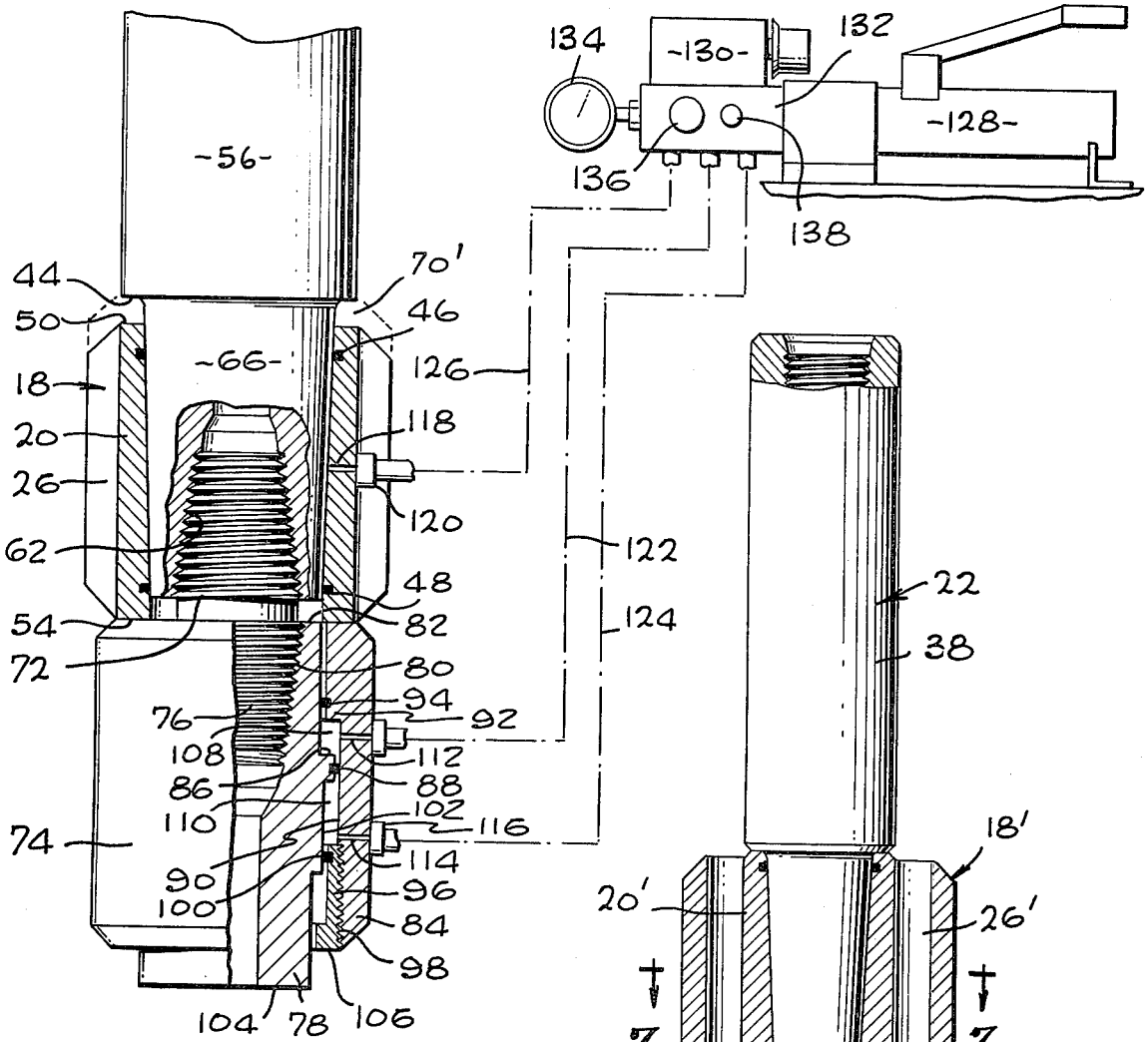
Fig. 7
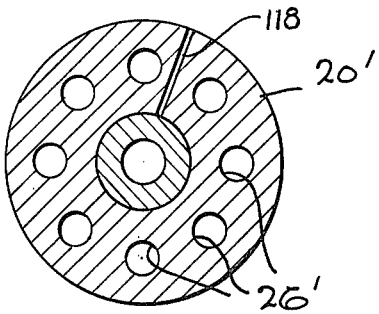
Fig. 6

STABILIZER FOR DRILL STRINGS

The present invention relates to rotary bore hole drilling devices, and is more particularly concerned with the novel mounting of a stabilizer onto a drill string body structure to provide a strong connection between the drill string body structure and the stabilizer, while permitting easy removal and replacement of the stabilizer when necessary.

The provision of stabilizers along a drill string is well known, the stabilizer having the purpose of retaining the drill string, and particularly the drill bit, in a coaxial or centered position in the bore hole being drilled. Heretofore, stabilizers have been threadedly connected along the body structure of a rotary drill string, or at the lower portion of the drill string adjacent to the drill bit. To achieve high drilling speeds, or penetration rates, or straight hole or directional drilling of the bore hole, appropriate drilling weight on the drill bit is required which is generally achieved through the use of drill collars. When imposing such drilling weights on the bit, the drill collars tend to deflect, which is avoided by the use of stabilizers.

Through deflection, unforeseen changes in direction occur. Usually, a plurality of stabilizers are mounted on the drill string at desired intervals. The stabilizers have guiding elements thereon in contact with the bore wall, and which, accordingly, may be subjected to relatively high wear during drilling. Although highly wear-resistant materials are used in the construction of these guiding elements, their life is low under the high wearing action, particularly for the stabilizer located directly above the drill bit, since at this point increased demands are placed on the guidance function of the stabilizer. Restoration of the wear areas on the stabilizers, or replacement thereof on the drill string, requires removal of the stabilizer and transportation of the stabilizer body from the field to special workshops. Thus, in addition to considerable repair cost, a substantial expenditure in time, transportation, and other costs is required.

In order to solve the above problems, various means have been tried in the prior art, but without achieving a simple solution for readily securely mounting the stabilizer on the drill string body and for readily removing and replacing the stabilizer when it has become worn. Thus, various methods of threadably connecting the stabilizer sleeve to the body portion of the drill string have been provided, which have been found unsatisfactory. Other designs have provided for welding the stabilizer sleeve to the drill string body, but this again requires the use of special workshops for replacing the stabilizers when necessary. In addition, welding may adversely affect the heat treatment of the stabilizer and of the drill collar body to which it is secured.

The present invention provides a solution to the above problem, which permits a close, safe and secure connection between a stabilizer surrounding the body portion of a drill string and the engaged body portion, and which safely withstands the stresses occurring during the drilling operation in the bore hole, yet permits quick and easy removal and replacement of the stabilizer when it becomes worn or otherwise ceases to function to maintain the drill string coaxial. According to the present invention, the stabilizer body in the form of a sleeve has a conically-shaped interior surface which is shrink-fitted onto a mating or corresponding exterior conical surface of a body portion of the drill string. One or more of such stabilizers may be so mounted at intervals along the drill string, and also adjacent the drill bit. The shrink-fit between the stabilizer and the body portion of the drill string is such that the stresses occurring during drilling are safely transmitted without relative movement between the parts. Such power transmission can be further improved by incorporating friction increasing media, such as silicon carbide or tungsten carbide powders, or other grit, between the adjacent surfaces of the stabilizer sleeve and body portion of the drill string, to increase the coefficient of friction between such surfaces.

In addition to the basic function of safe and efficient connection of the stabilizer to the body portion of the drill string, the present invention provides high versatility for various types of drilling operations. Thus, for example, it is possible to continue operations using the stabilizer located directly above the drill bit, even after partial wear of the stabilizer higher up in the string, since the guidance task of the string stabilizers are less essential than for the stabilizer adjacent the bit. Thus, whenever a stabilizer adjacent the drill bit is replaced, this generally results in more efficient guidance characteristics, even without the necessity of replacing the stabilizers higher up in the drill string.

The present invention possesses many other advantages, which will be made more clearly apparent from considering the various forms of the invention which are shown in the accompanying drawings and form part of the present specification. These forms are described in detail below for purposes of illustrating the general principles of the invention, but it is to be understood that such detailed description is not to be taken as limitative.

Referring to the drawings:

FIG. 5 illustrates the mounting of a stabilizer sleeve on the body portion of a drill string adjacent to the drill bit, disclosing the mounting equipment;

FIG. 6 is an elevational view and longitudinal section of a stabilizer mounted on a drill string body portion, similar to FIG. 2, but wherein a modified form of stabilizer is employed; and FIG. 7 is a horizontal section taken on the line 7—7 of FIG. 6.

Figure 1:
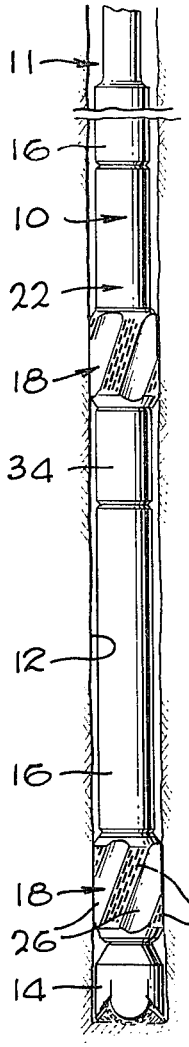
FIG. 1 is a side elevational view of the lower portion of a rotary drill string with stabilizers mounted thereon and embodying the invention principles.

Referring to the drawings, with particular attention to FIG. 1, there is shown the lower portion 10 of a rotary drill string 11 positioned in a bore hole 12. At the bottom of the hole is a working drill bit 14, which is screwed into the lower end of the drill collar portion 16 constituting the lower end of the drill string, as illustrated in greater detail in FIG. 4, with the bit body bearing against the lower end **56*a* of a drill collar sub 56. The drilling weight on the drill bit is provided mainly by the string of drill collars 16. The upper portion of the drill string 11 extends to the top of the hole 12**, serving for transmission of the torque to the bit and the feeding of the drilling mud to the bottom of the hole, the mud flowing through the drill bit and returning upwardly with the cuttings through the annulus around the drill string, as is known in the art.

By mounting stabilizers 18 at intervals along the string of drill collars, and also at the lower end of the drill collar string just above the drill bit, according to the present invention, centering of the drill collar string in the hole 12 is achieved. It will be noted that the greatest demands are made on the stabilizer 18 immediately above the drill bit 14, since after relatively little wear on the latter stabilizer, as compared to the stabilizers positioned at higher elevations along the drill string, undesired deflection of the hole may occur.

Figure 2:
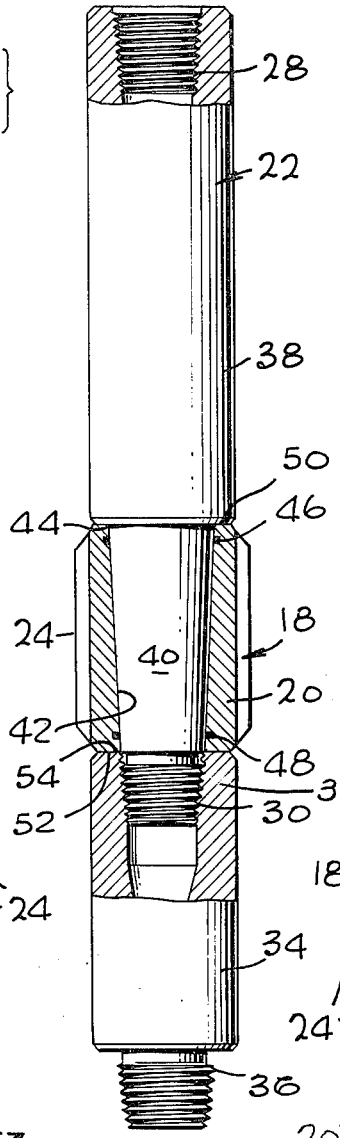
FIG. 2 is a longitudinal section, partly disclosed in elevation, of a stabilizer mounted on a body portion of the drill string above the drill bit.
Figure 3:
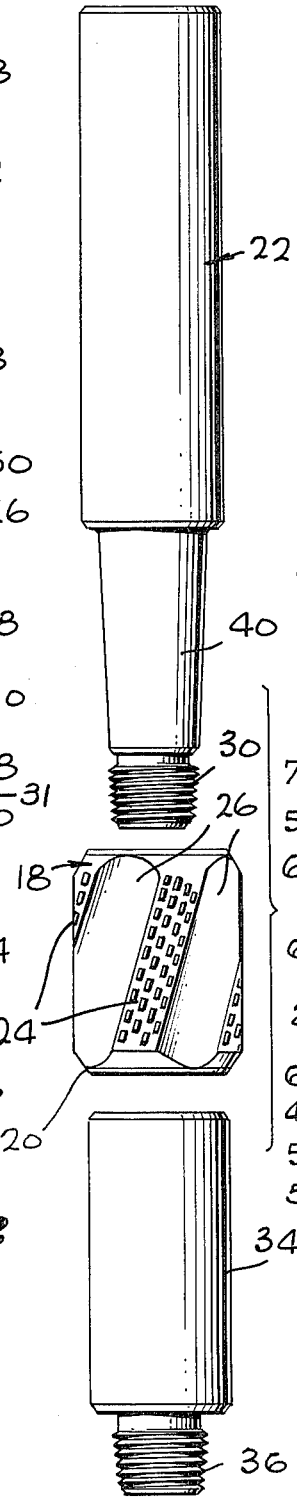
FIG. 3 is an exploded elevational view of the stabilizer and drill string body portion combination shown in FIG. 2.

The stabilizers 18 disclosed in FIGS. 2 and 3 are comprised of a sleeve 20 positioned on a body portion or sub 22 of the drill string, a plurality of external spiral ribs 24 being integral with the sleeve. Each stabilizer 18 has an effective diameter corresponding to the diameter of the hole to properly center the drill string and bit in the hole, the inclined ribs overlapping each other to insure the ability of the ribs to collectively contact the wall of the hole around its full circumference. Drilling mud and cuttings can flow upwardly through the spiral passages 26 between the ribs 24.

The external contact surfaces of the spiral ribs 24 are highly wear resistant, but should preferably have no cutting edges which could undesirably increase the diameter of the hole. The breaking of stabilizer ribs 24 as a result of heavy impact stresses on the stabilizers during the drilling operation should be avoided. Accordingly, high quality and high strength steel, such as 4140 AISI steel, is used in the construction of both the stabilizers 18 and the body portions 22 of the drill string to which the stabilizers are connected.

As shown in FIG. 2, a stabilizer 18 is mounted on a body portion or sub 22 of the drill collar string, the upper end of the body portion 22 being constituted as a conical threaded box 28 for connection with a corresponding threaded pin (not shown) of an adjacent drill collar section 16. The lower end of the body portion 22 has a conical threaded pin 30 for connection with a companion threaded box 31 of a connecting body or sub 34, which, in turn, can be threadedly connected by its pin 36 to another drill collar section 16. Alternatively, the conical threaded pin 30 could be connected directly to the threaded box of a drill collar section 16.

Between the pin thread 30 and the cylindrical portion 38 of the body 22, the latter has a slightly tapered body or pin portion 40, providing a conical external surface corresponding to and adapted to receive a mating internal or inner conical surface 42 of the stabilizer sleeve 20. The conical body member 40 is of a reduced diameter with respect to the diameter of the cylindrical portion 38 of the body portion 22, providing a transverse shoulder 44 therebetween. The internal conical surface of the sleeve 20 of the stabilizer 18 is shrink-fitted onto the external mating conical surface of the body member 40, the internal surface 42 of the sleeve 20 being provided with circumferential grooves to receive internal spaced upper and lower elastomer seals 46 and 48 to aid in mounting the stabilizer 18 by a shrink-fit on the body member 40, as described below, and in maintaining the shrink-fitted stabilizer on the tapered body member 40. The angle of taper of the body member 40 and the internal surface of the stabilizer sleeve 20 can range from about ¼° to 4°, e.g., about ½°, for effective stabilizer application and retention.

When the stabilizer 18 is properly shrink-fitted on the body member 40, as described in detail below, the upper end 50 of the sleeve 20 is in engagement with the shoulder 44 of the member 22, forming a metallic seal therebetween. Similarly, a metallic seal is provided by the upper shoulder 52 of the connecting body or sub 34 contacting the lower end 54 of the stabilizer sleeve 20, upon threading the sub 34 on the pin 30. These metallic seals prevent the drilling mud from entering the interior of the sleeve 20 and contaminating the tapered coengaging surfaces on the sleeve and body member 40.

Figure 4:
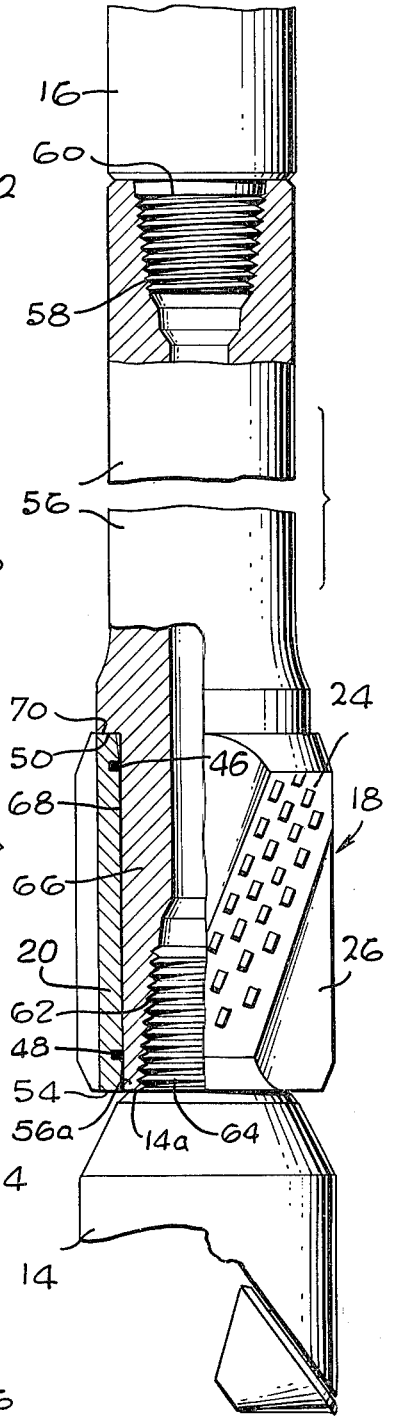
FIG. 4 is a longitudinal view, shown partly in elevation and partly in section, of a stabilizer mounted closely adjacent a drill bit, according to the invention.

Referring to FIG. 4, a body member or sub 56 is threadedly connected by a box thread 58 to a pin 60 of a drill collar section 16. The lower end portion of the body member or sub 56 also has a threaded box 62 for threaded engagement with a pin 64 forming the upper portion of the drill bit 14. In this embodiment, the sub 56 has a lower portion 66 of reduced diameter and providing a conical surface 68 which tapers downwardly.

A stabilizer 18 having a conical or tapered internal surface 42, corresponding to the surface 42 of FIG. 2, is shrink-fitted onto the conical lower end portion 66 of the sub 56, with the upper end 50 of the stabilizer in engagement with a shoulder 44 on the sub 56, the lower end 54 of the stabilizer being disposed at the lower end of the sub 56 slightly above the end 56*a* of the sub 56 engaged by the drill bit shoulder 14*a*.

FIG. 5 of the drawings illustrates the method and fluid or hydraulically actuated equipment for effecting a shrink-fit of a stabilizer 18 onto a conical member, such as 66 (FIG. 4) or 40 (FIG. 2) of a body portion of the drill string. In the particular embodiment illustrated in FIG. 5, the stabilizer 18 is shown being secured to the conical end portion 66 of the sub 56, to which the drill bit 14 is connected at the bottom of the drill string, as shown in FIG. 4. The tapered end portion 66 can be first cleaned, and, if desired, to increase the coefficient of friction, as previously noted, can be coated with an abrasive material, such as tungsten carbide powder, e.g., by application of a suspension of 10% by volume of the tungsten carbide particles of 200 mesh size in a light oil. The stabilizer sleeve 20 is then pushed on the tapered end portion or pin 66 until the upper and lower seals 46 and 48 are both engaged with the pin surface 66, at which time there is space 70, e.g. of about ⅜ inch, between the end 50 of the sleeve 20 and the shoulder 44 of the body portion or sub 56.

In the case of mounting a bit stabilizer, that is, mounting of the stabilizer 18 on the sub or collar to which the bit 14 is secured, as shown in FIG. 4, a double threaded pin 72 is screwed into the box thread 62 of the body member 66 and a fluid or hydraulic mounting tool, indicated generally at 74, is connected to the lower pin 76 of the double pin 72. The mounting tool 74 has a piston 78 containing an internal conical thread 80 at its upper end for threaded connection to the lower pin 76. The piston 78 has mounted thereon an annular cylinder 84 which is axially movable along the piston 78. Piston 78 has a peripheral shoulder or land 86 which carries in a groove therein a seal 88 in slidable engagement with the inner surface 90 of the cylinder 84. The cylinder 84 is provided with an inwardly extending upper head 92 which carries an internal peripheral seal 94 for slidable engagement with the exterior surface of the piston 78 above the land 86.

A cylinder head 96 is threadedly mounted on the interior lower skirt portion of the cylinder 84, the cylinder head 96 having mounted in its upper inner surface an internal peripheral seal 100 which makes a slidable contact with the adjacent exterior surface 102 of the piston 78. The lower end 104 of the piston 78 is of reduced diameter, the head 96 having an internal peripheral flange 106 at its lower end engaging with a piston shoulder thereabove to limit the extent of axial movement of the cylinder along the piston in one direction, movement of the cylinder in the opposite direction being limited by the head 92 engaging the land 86.

The above described arrangement, as shown in FIG. 5, provides an upper hydraulic or fluid chamber 108 and a lower hydraulic chamber 110 between the piston 78 and cylinder 84. Ports 112 and 114 provide communication of hydraulic or other pressure fluid to the chambers 108 and 110, respectively, such ports communicating the suitable connections 116 from which suitable pressure hoses or lines extend, as described in greater detail below.

The stabilizer sleeve 20 has a port 118 intermediate its ends for introduction of pressure fluid into the space between the interior surface of the stabilizer and the adjacent exterior surface of the pin or body portion 66, such port communicating with a suitable fitting 120 removably secured to the sleeve 20. For actuation of the hydraulic tool 74 for shrink-fitting the stabilizer sleeve 20 onto the tapered pin 66, pressure hose lines 122 and 124 extend, respectively, to the upper and lower fittings 116, and a pressure hose 126 extends from the fitting 120. The hoses 122, 124 and 126 are connected to a hydraulic pump unit 128 of conventional type, including a valve gear block 130, a pressure distributor 132, a control manometer 134, a pressure ratio governor 136 and a relief valve 138. Pressure is applied via hose 122 to the pressure space or chamber 108, and via hose 126 and port 118 to the space between the stabilizer sleeve 20 and the adjacent conical surface of the member 66, the interior sealing rings 46 and 48 preventing escape of the hydraulic fluid or pressure medium. The fluid at a suitable pressure derived from the pump unit 128 is introduced between the interior surface of the stabilizer sleeve 20 and the external surface of the pin 66 to expand the sleeve 20 with respect to the exterior surface of the pin 66 and contract the pin 66. Simultaneously, application of pressure to the chamber 108 forces the cylinder 84 in an axial upward direction against the lower end 54 of the sleeve 20, forcing the stabilizer sleeve 20 upward along the tapered pin 66 toward the shoulder 44.

The pressure in the chamber 108 and the pressure in the inner space between the adjacent surfaces of the stabilizer sleeve 20 and pin 66 are synchronized so that the stabilizer sleeve is pushed upwardly until the upper shoulder 50 of the sleeve 20 is in engagement with the lower shoulder 44 of the body portion 22, as shown in dotted lines in FIG. 5. Relieving of the pressure in the line 126 permits the sleeve 20 to contract and the pin 66 to reexpand, resulting in the sleeve having a large surface of frictional engagement with the pin 66, the resulting shrink-fit, in effect, integrating the sleeve to the pin. When the hydraulic pressure is released, a large hoop stress remains in the stabilizer sleeve 20, which can be, for example, about 7,000 p.s.i., insuring a powerful gripping force between the sleeve and pin. This gripping or friction force can be greatly increased, if necessary, by interposing a suitable grit, such as the 200 mesh tungsten carbide, between the tapered surfaces.

After the sleeve 20 has reached its above-noted position on the member 66, so that the sleeve 20 engages the shoulder 44, and is now shrink-fitted on the pin 66, the hydraulic pressure in the lines 122 and 126 is relieved by means of the valve gear 130 and distributor 132, and the fittings 116 and 120 removed. The hydraulic mounting tool 74 is then disconnected by unscrewing the piston 78 from the pin 76, the double pin 72 then being unscrewed from the tapered box 62. The sub 56 with the stabilizer 18 shrink-fitted on the pin 66 can now be incorporated in the drill string, and a drill bit 14 threadedly connected to the tapered pin 66, as illustrated in FIG. 4.

It will be understood that where a stabilizer is to be mounted on a drill collar at an intermediate position of the drill string, as illustrated in FIG. 1, the double pin 72 is not needed since the body member 22 already has a threaded pin 20 at its lower end. The stabilizer sleeve 18 can be shrink-fitted onto the pin 40 of FIGS. 2 and 3, in the manner described above, by connecting the hydraulic mounting tool 74 to the pin 30 by screwing the piston 78 of the mounting tool onto such pin.

By way of example, a stabilizer sleeve 18 is shrink-fitted onto the body member 66 or the body member 40 has remained immovably fixed on such body member until a torque of about 42,000 to 540,000 ft. lbs. has been applied, depending on the sleeve diameter and length.

For demounting the stabilizer sleeve 18 when it has become worn, the same hydraulic tool and equipment described above and illustrated in FIG. 5 can be employed. For this purpose, and referring again to FIG. 5, after disconnecting the body portion 56 from the drill string, the double pin 72 is again threaded into the member 66 and the mounting tool 74 threaded on the lower pin 76. The hose 126 is placed in communication with the port 118 and pressure applied to the inner space of the stabilizer sleeve 20 between the sleeve and pin 66. If required, the hose 124 can be placed in communication with the cylinder space 110 and pressure applied to this space, causing the cylinder 84 to move downwardly until the head 92 abuts the piston shoulder 86, thereby leaving a short longitudinal space between the lower end 54 of the stabilizer sleeve 20 and the upper end of the cylinder. Applying fluid pressure to the interior of the stabilizer sleeve 20 and against the contacting exterior surface of the pin 66 between the upper seal 46 of the stabilizer and the lower seal 48 thereof causes the stabilizer sleeve 20 to expand away from the contacting exterior surface of the pin 66. At the same time, the fluid pressure is acting over the differential area in the interior of the sleeve 20 provided by the relatively large diameter ring 46 and the smaller diameter seal ring 48, forcing the sleeve downwardly of the pin 60 and against the upper end of the cylinder, which serves as a stop to prevent possible damage and injury to personnel.

If desired, pressure fluid need not be introduced into the pressure space 110 since the cylinder 84 in any event will assume or be forced by the expanded and pressurized sleeve to its downwardmost position with the head 92 and piston shoulder 86 in contact.

After the stabilizer sleeve 18 has thus been released from the tapered body member or pin 66, the mounting tool 74 is removed, as described above, to permit withdrawal of the stabilizer 18. A replacement stabilizer 18 can then be mounted in its place on the tapered pin 66 by shrink-fitting thereon, employing the mounting tool and hydraulic pressurizing equipment in the manner described above and shown in FIG. 5.

Expansion pressures applied for mounting and effecting shrink-fitting of the stabilizer sleeve on the body 56 of the tool, and for removing the sleeve therefrom, can range from about 10,000 to about 14,000 p.s.i.

Referring to FIGS. 6 and 7, there is shown a modification of the stabilizer 18 shown in FIG. 2. Stabilizer 18[1] includes a cylindrical sleeve 20[1] provided with a plurality of axially disposed concentric parallel bore holes 26[1] for passage of drilling mud upwardly through the bore hole. In all other respects, it is the same as the sleeve 20 of FIG. 2 and 4, is related in the same manner to the body 22 or 56, and is mounted thereon and removed from its associated tapered pin 40 or 66 in the same manner.

A number of advantages accrue from the present invention. Thus, according to the present invention, the stabilizer is field replaceable, requiring the sleeve only to be replaced, so that such operation need not be done in a workshop. Thus, an old stabilizer sleeve can be removed and replaced with a new sleeve at the well bore site in about 15 minutes. The stabilizer sleeve does not form a part of the threaded joint, and the joint can be made up independently of the presence of the sleeve, as disclosed in FIG. 4. The sleeve merely serves as a stop to limit the make-up torque of the threaded joint in the form of invention disclosed in FIG. 2. The sleeve remains fixed to its associated body, and will not move relatively thereon unless subjected to a torque which is much greater than the torque strength of the threaded connections.

The shrink-fitting of a stabilizer on the drill string body effects substantial savings in manufacturing, maintenance and replacement costs. The present invention also permits interchangeability of all the stabilizer sleeves, whether used as a stabilizer adjacent to the bit or as a stabilizer positioned along the drill string. Further, the shrink-fitted stabilizer is superior to stabilizers of the prior art mounted on the drill string body by threaded connections, in that the powerful shrink-fit of the present stabilizer avoids damage or destruction of the threaded connection of the prior art stabilizers. Shrink-fitted stabilizers have advantages over stabilizers welded on an associated drill string or drill collar member, the welding adversely affecting the heat treatment of the parts.

We claim:

1. A rotary drill string stabilizer apparatus for use in rotary drilling of a bore hole: a body structure having connecting means adapted to secure such structure in a tubular running string, said body structure including a body member having a conical outer surface and a passage therethrough through which drilling fluid from the tubular running string can flow, a stabilizer comprising a stabilizer sleeve having a conical inner surface matching the conical configuration of said conical outer surface of said body member, said stabilizer sleeve being mounted on said body member with said conical outer and inner surfaces in friction contact, said stabilizer sleeve having an effective outside diameter conforming to the diameter of the bore hole, said sleeve having a plurality of longitudinal passages for the longitudinal flow of drilling fluid therethrough, longitudinally spaced peripheral seals preventing fluid leakage between said inner and outer surface from the region between said seals, and means for conducting fluid under pressure to the region between said conical inner surface and conical outer surface and between said seals to expand said sleeve and enable said sleeve to be moved relatively longitudinally along said conical outer surface to shrink-fit said sleeve on said body member upon relieving of the fluid pressure.

2. Apparatus as defined in claim 1; the angle of taper of said conical surfaces of said body member and said stabilizer sleeve ranging from about ¼° to about 4°.

3. Apparatus as defined in claim 1; said body structure having a cylindrical body portion extending from said conical outer surface and also having a shoulder adjacent the large diameter end of said conical outer surface, said stabilizer sleeve abutting said shoulder.

4. Apparatus as defined in claim 1; said stabilizer sleeve comprising a plurality of circumferentially spaced, longitudinal parallel holes therethrough.

5. Apparatus as defined in claim 1; said body member including a threaded portion for connection to an adjacent member, said stabilizer sleeve encircling said threaded portion of said body member.

6. A rotary drill string stabilizer apparatus as defined in claim 5; a drill bit having a threaded portion threadedly connected to said other threaded portion, said drill bit having an upper shoulder in contact with the lower end of said body member and positioned adjacent the lower end of said stabilizer sleeve.

7. Apparatus as defined in claim 1; said connecting means including a pin threaded at one end of said body member and a box thread at its opposite end for connection to companion threaded members in said drill string.

8. Apparatus as defined in claim 7; said body structure having a cylindrical body portion extending from said conical outer surface and also having a shoulder adjacent the large diameter end of said conical outer surface, said stabilizer sleeve abutting said shoulder.

9. Apparatus as defined in claim 8; the angle of taper of said conical surfaces of said body member and said stabilizer sleeve ranging from about ¼° to about 4°; said stabilizer sleeve comprising a plurality of sprirally shaped external ribs on the exterior of said sleeve providing said longitudinal passages therebetween.

10. Apparatus as defined in claim 1; the running string including a plurality of drill collars, and including a plurality of said body members longitudinally spaced from each other and each having mounted thereon said shrink-fit stabilizer.

11. Apparatus as defined in claim 10; the angle of taper of the conical surface of each body member and stabilizer sleeve mounted thereon ranging from about ¼° to about 4°; each stabilizer sleeve comprising a plurality of spirally shaped external ribs on the exterior of each stabilizer sleeve providing said longitudinal passages therebetween.

* * * * *

UNITED STATES PATENT AND TRADEMARK OFFICE

CERTIFICATE OF CORRECTION

PATENT NO. : 3,945,446

DATED : March 23, 1976

INVENTOR(S) : ALFRED OSTERTAG and CLAUS MARX

It is certified that error appears in the above-identified patent and that said Letters Patent are hereby corrected as shown below:

Column 6, line 53, after "diameter" insert -- seal --.

Column 8, line 4, change "surface" to -- surfaces --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*